US008696068B2

(12) United States Patent
Li et al.

(10) Patent No.: US 8,696,068 B2
(45) Date of Patent: Apr. 15, 2014

(54) CUTTING DEVICE WITH FUNCTION OF CHANGING DIAMETER IN SMALL RANGE FOR SOFT ROCK SHIELD MACHINE

(75) Inventors: Jianbin Li, Zhengzhou (CN); Yulian He, Zhengzhou (CN)

(73) Assignee: China Rall Way Tunneling Equipment Co., Ltd., Zhengzhou, Henan (CN)

( * ) Notice: Subject to any disclaimer, the term of this patent is extended or adjusted under 35 U.S.C. 154(b) by 0 days.

(21) Appl. No.: 13/516,236

(22) PCT Filed: Apr. 18, 2011

(86) PCT No.: PCT/CN2011/072900
§ 371 (c)(1),
(2), (4) Date: Jun. 15, 2012

(87) PCT Pub. No.: WO2012/024938
PCT Pub. Date: Mar. 1, 2012

(65) Prior Publication Data

US 2012/0248848 A1 Oct. 4, 2012

(30) Foreign Application Priority Data

Aug. 24, 2010 (CN) ..... 2010 1 0261104

(51) Int. Cl.
*E21D 9/11* (2006.01)
*E21D 9/00* (2006.01)

(52) U.S. Cl.
CPC ..... *E21D 9/003* (2013.01); *E21D 9/115* (2013.01)
USPC ..... 299/1.8; 299/61

(58) Field of Classification Search
USPC ..... 299/1.05, 1.8, 61
See application file for complete search history.

(56) References Cited

U.S. PATENT DOCUMENTS

| | | | | |
|---|---|---|---|---|
| 2,937,859 | A * | 5/1960 | Jackson | 299/80.1 |
| 2,953,362 | A * | 9/1960 | Thassy et al. | 299/1.8 |
| 4,316,635 | A * | 2/1982 | LeBegue et al. | 299/80.1 |
| 4,998,776 | A * | 3/1991 | Chida et al. | 299/59 |
| 6,347,838 | B1 * | 2/2002 | Mukaidani et al. | 299/55 |
| 2011/0031017 | A1 * | 2/2011 | Iwata et al. | 175/40 |

FOREIGN PATENT DOCUMENTS

CN 201540105 U * 8/2010

OTHER PUBLICATIONS

Robbins Trio Dig Deep in Mexico, Apr. 2009, World Tunnelling, Apr. 2009, p. 12.*

* cited by examiner

*Primary Examiner* — David Bagnell
*Assistant Examiner* — Michael Goodwin
(74) *Attorney, Agent, or Firm* — Raymond Y. Chan; David and Raymond Patent Firm

(57) ABSTRACT

A cutting device includes a cutting head, a plurality of peripheral cutters mounted on the cutting head, at least one peripheral cutter driving mechanism, a hydraulic control system, and a dissipation monitoring system, wherein the cutting head has at least one groove, wherein the peripheral cutters are symmetrically mounted on the cutting head at two sides of the groove, wherein the peripheral cutters are connected with the peripheral cutter driving mechanism which is provided on the groove, wherein the hydraulic control system includes a hydraulic tank arranged to drive the peripheral driving mechanism to move for driving the peripheral cutter to move correspondingly, wherein the hydraulic control system further includes a connector, a motion sensor electrically connected to the connector through a plurality of electrical wires, wherein the connector is communicated with the hydraulic tank through a plurality of transmission tubes and a fluid outlet.

12 Claims, 7 Drawing Sheets

CUTTING DEVICE WITH FUNCTION OF CHANGING DIAMETER IN SMALL RANGE FOR SOFT ROCK SHIELD MACHINE

BACKGROUND OF THE PRESENT INVENTION

1. Field of Invention

The present invention relates to a tunnel boring machine, and more particularly to a cutting arrangement for a tunnel boring machine which is capable of providing a shield with varying diameters.

2. Description of Related Arts

According to the definition used by the International Society for Rock Mechanics, soft rocks are defined as rocks having low mechanical strength, high porosity, a low degree of cementation, and are substantially affected by wind erosion, or those having a large amount of expansive clay minerals. Such rocks usually consist of mudstone, shale, siltstone, sandstone, or any other naturally formed rocks having an axial compressive strength of less than 25 MPa.

Tunnel boring machines used in soft ground are called soft ground tunnel boring machines. Conventional tunnel boring machines usually comprises a rotating cutting head and a plurality of cutting tools securely provided on the cutting head. Conventional tunnel boring machines may bore tunnels in various diameters. The resulting tunnel diameter depends on a cutting diameter of the rotating cutting head and operation and the dimensions of the cutting tools. Conventionally, for almost all tunnel boring machines, the rotating cutting head and the cutting tools are manufactured to a predetermined size and configuration so that each tunnel boring machine can only used for boring tunnel having a fixed predetermined tunnel diameter. The disadvantage of this limitation is that engineers and technicians are unable to alter the size of the rotating cutting head and the positions of the cutting tools on the rotating cutting head for altering the diameter of resulting bored tunnel. In other words, for conventional tunnel boring machines, the only way of boring tunnel of various diameters is to require engineers or technicians to enter the tunnel and change the cutting tools. Obviously, this practice is very dangerous to the engineers and the technicians concerned and substantially increases construction costs and time of the relevant tunnel. In some situations, engineers or technicians are unable to enter the tunnel or perform changing procedure on the rotating cutting machine. In these situations, the diameter of the tunnel cannot be altered according to environmental or to engineering circumstances and this substantially affect the quality of the construction work.

SUMMARY OF THE PRESENT INVENTION

An object of the present invention is to provide a tunnel boring machine which is capable of conveniently and selectively adjusting a boring diameter of a rotating cutting head so as to facilitate adjustment of the diameter of the tunnel during the relevant construction work. The adjustment feature substantially enhances the flexibility of the tunnel boring machine when the construction work is in progress.

Additional advantages and features of the invention will become apparent from the description which follows, and may be realized by means of the instrumentalities and combinations particular point out in the appended claims.

In order to accomplish the object mentioned above, the present invention provides a cutting device for a tunnel boring machine.

The cutting device comprises a cutting head, a plurality of peripheral cutters mounted on the cutting head, at least one peripheral cutter driving mechanism, a hydraulic control system, and a dissipation monitoring system, wherein the cutting device is characterized in that the cutting head has at least one groove, wherein the peripheral cutters are symmetrically mounted on the cutting head at two sides of the groove, wherein the peripheral cutters are connected with the peripheral cutter driving mechanism which is provided on the groove, wherein the hydraulic control system comprises a hydraulic tank arranged to drive the peripheral driving mechanism to move for driving the peripheral cutter to move correspondingly, wherein the hydraulic control system further comprises a connector, a motion sensor electrically connected to the connector through a plurality of electrical wires, wherein the connector is communicated with the hydraulic tank through a plurality of transmission tubes and a fluid outlet, wherein the monitoring system comprises a detection probe provided on the cutting head, an alarm device, and a plurality of wires extended between the detection probe and the alarm device for generating an alarm signal when the detection probe is dissipated beyond a predetermined threshold.

Moreover, the peripheral cutter driving mechanism comprises a plurality of cutter bases provided on the cutting head, a plurality of connecting members connected to the cutter bases respectively, and a supporting member extended between the connecting members, wherein the hydraulic tank further has a top protection plate provided at a top end thereof, and is positioned underneath the supporting member of the peripheral cutter driving mechanism, wherein the hydraulic control system further comprises a piston member movably mounted in the hydraulic tank and is communicated with the corresponding supporting member, wherein the motion sensor is provided on the piston member, wherein the motion sensor is electrically connected to the connector through a plurality of electrical wires.

The cutting head further comprises a sliding base unit, wherein the peripheral cutter is connected to the sliding base unit, wherein the sliding base is sandwiched between two of the cutter bases, wherein the cutter base is connected to one end of the corresponding connecting member, while another end of the connecting member is securely connected to the supporting member.

Furthermore, the cutting head has an extension tube provided thereon, wherein the detection probe has a tubular structure provided at the extension tube, wherein the wires are received and extended in the detection probe, wherein the detection probe is filled with a predetermined amount of epoxy resin for providing sufficient insulation to the wires.

The alarm device comprises an alarm relay, a warning light and an alarm speaker, wherein the detection probe of the monitoring system is mounted on an extension tube of the cutting head, wherein the wires are extended to the detection probe and is connected between an earth terminal and the alarm relay through the connector, wherein the alarm relay is electrically connected to a power source, whereas the warning light and the alarm speaker are also connected to the earth terminal and the power source through a closed terminal of the alarm relay.

The hydraulic tank comprises an inner protective cover, and outer protective cover, a first guiding member, and a second guiding member connected to the outer protective cover, wherein the second guiding member also connects to an outer surface of the inner protective cover, wherein the hydraulic tank further comprises a bearing base provided between the top protection plate and the inner protective cover in such a manner that a top side of the bearing base is connected to a bottom side of the top protection plate, whereas a top side of the inner protective cover is connected to a bottom side of the bearing base, wherein the bearing base has a ball bearing fittedly provided therein, wherein an inner diameter of the ball bearing is substantially the same as an outer diameter of the piston member.

The motion sensor is arranged to send a motion signal to the connector through the electrical wires and the connector is arranged to process the motion signal.

Finally, the peripheral cutters are provided at two ends of the groove respectively.

Compared to conventional technology, the present invention has the following advantages: the cutting device of the present invention is capable of detecting dissipation of the peripheral cutter and generating a corresponding alarm whenever necessary. Moreover, the present invention may allow the boring diameter of the cutting device to be varied so as to fit different construction circumstances. And because of these features, the present invention increases boring efficiency and effectiveness and ensures the safety of the relevant engineers and technicians.

DETAILED DESCRIPTION OF THE PREFERRED EMBODIMENT

Embodiment 1

Figure 1:
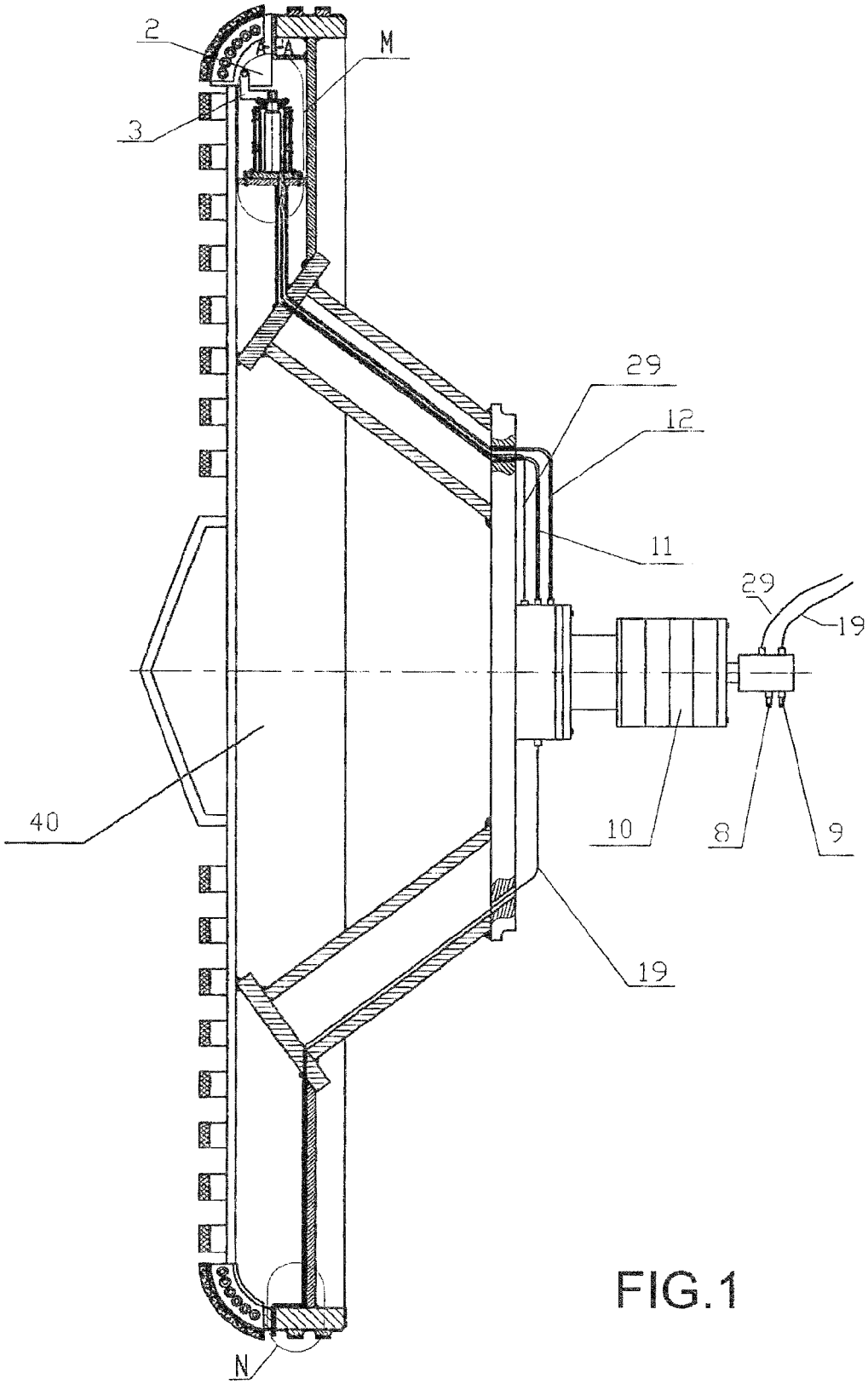
FIG. 1 is a schematic diagram of a tunnel boring machine according to a preferred embodiment of the present invention.
Figure 2:
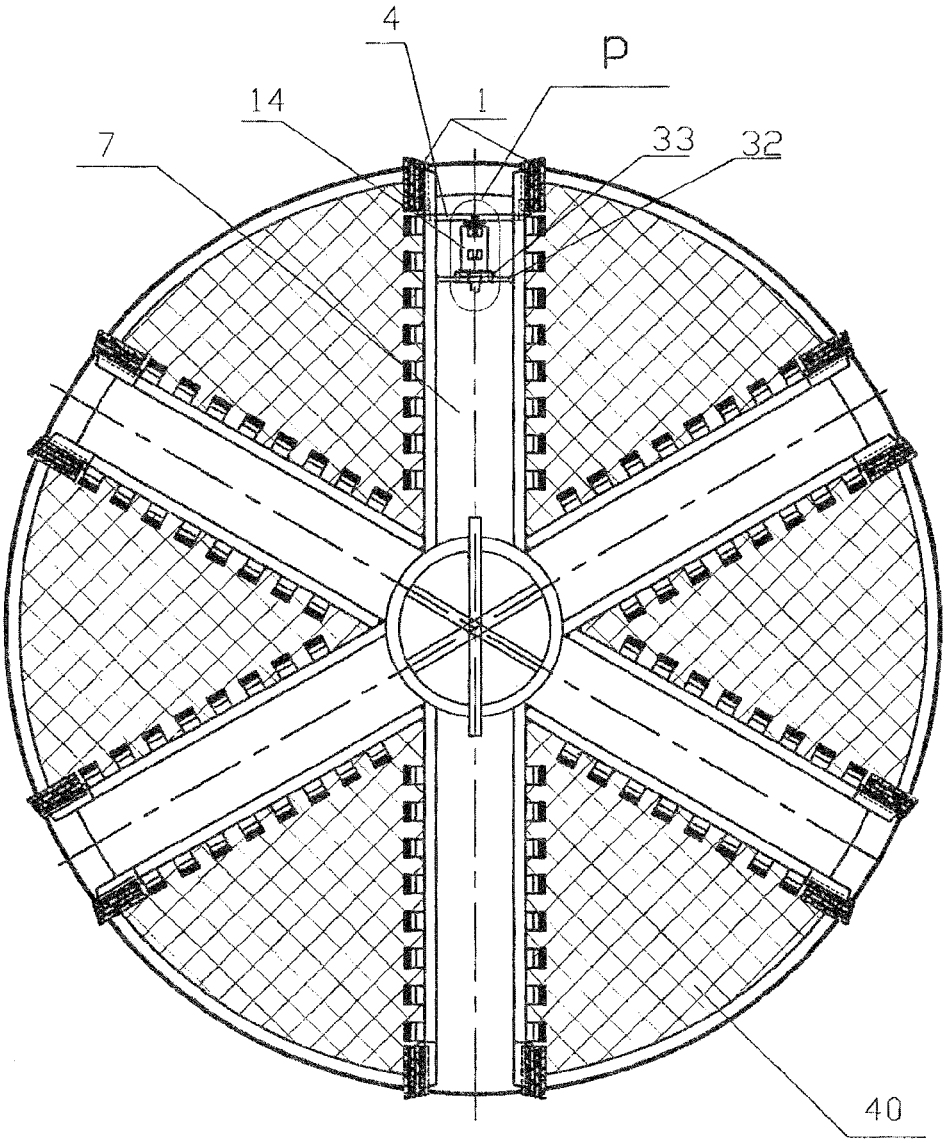
FIG. 2 is a schematic diagram of a cutting device of the tunnel boring machine according to the above preferred embodiment of the present invention.
Figure 3:
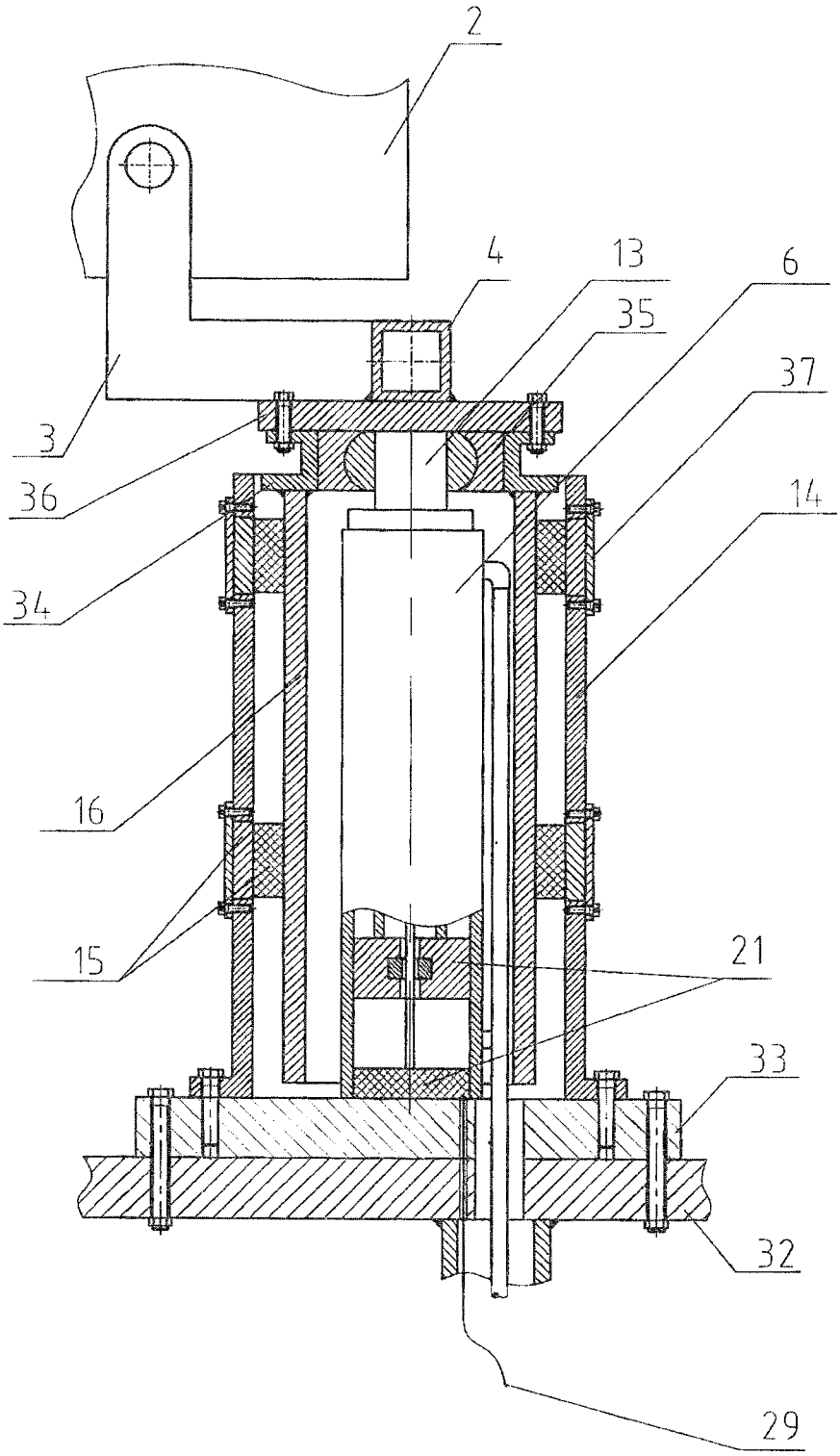
FIG. 3 is a partial schematic diagram of the tunnel boring machine according to the above preferred embodiment of the present invention, illustrating section M shown in FIG. 1.
Figure 4:
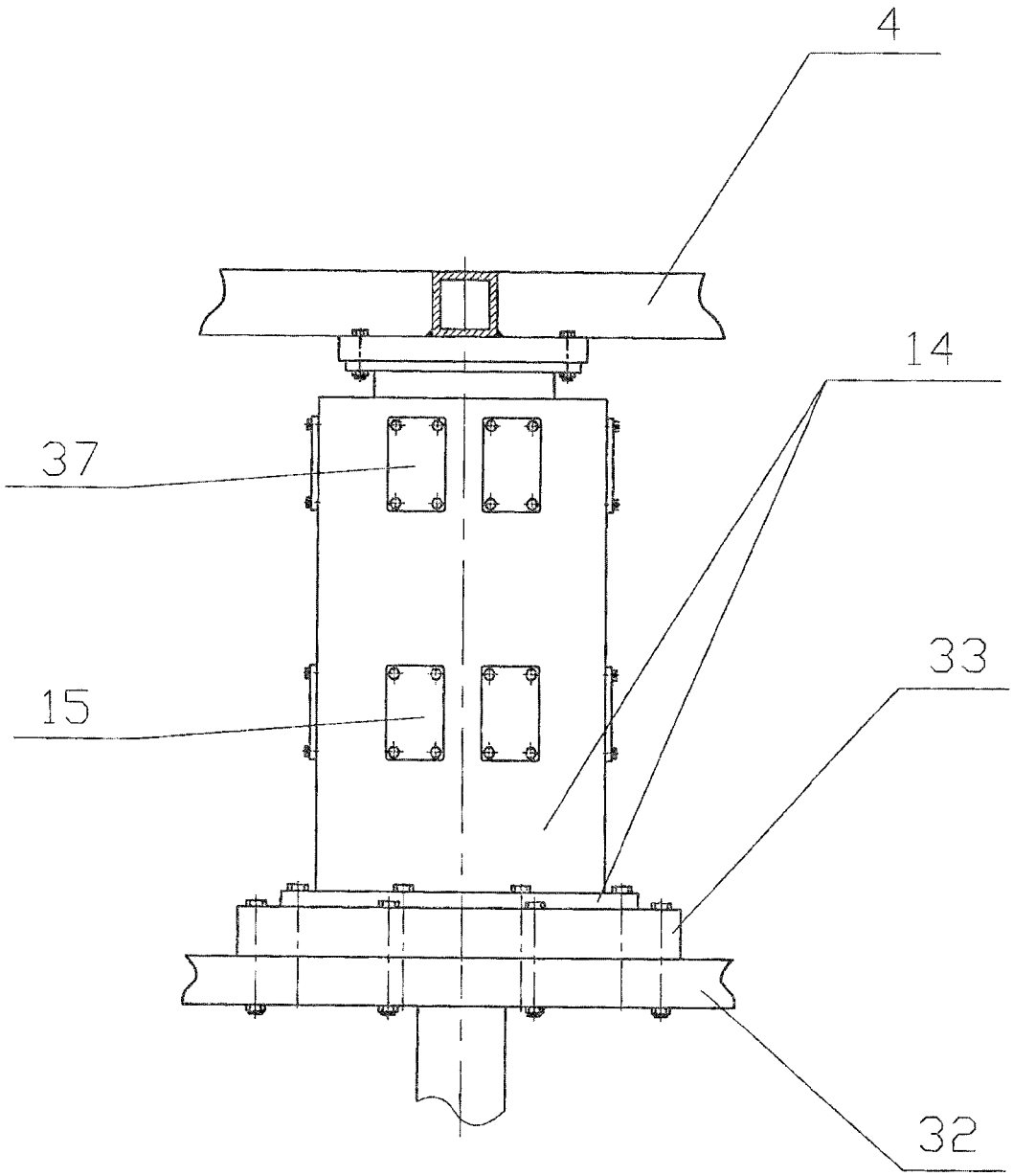
FIG. 4 is a partial schematic diagram of the tunnel boring machine according to the above preferred embodiment of the present invention, illustrating section P shown in FIG. 2.
Figure 5:
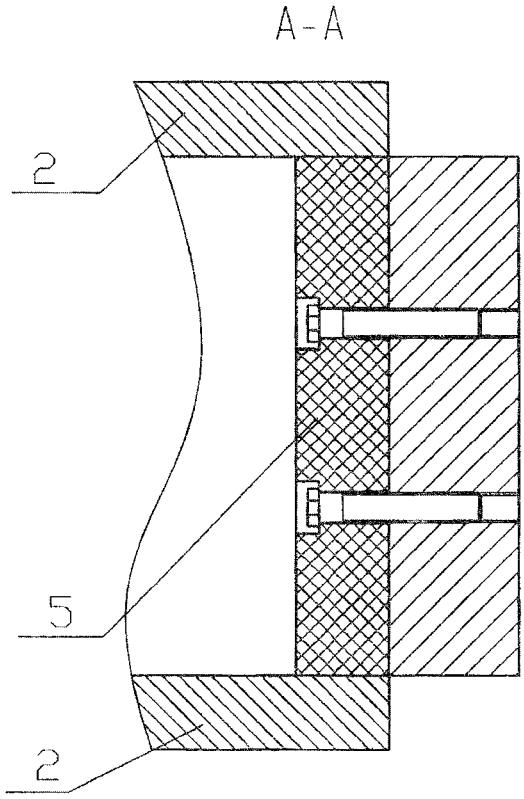
FIG. 5 is a sectional view of the tunnel boring machine according to the above preferred embodiment of the present invention, illustrating an A-A section as shown in FIG. 1.
Figure 6:
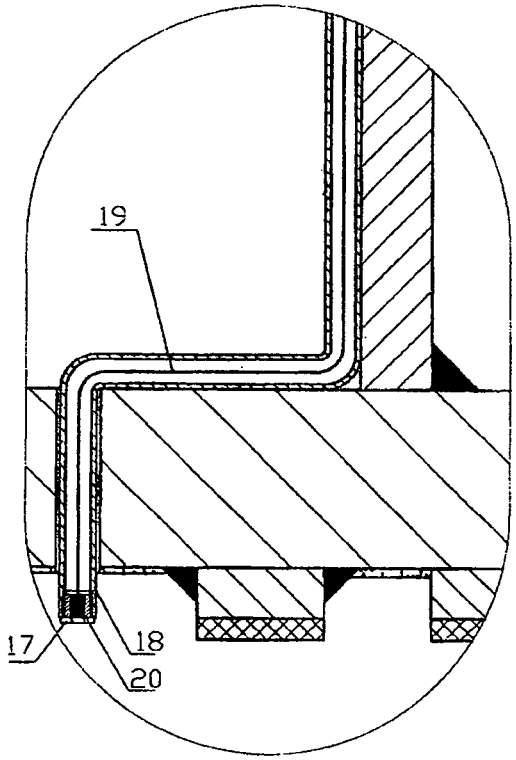
FIG. 6 is a partial schematic diagram of the tunnel boring machine according to the above preferred embodiment of the present invention, illustrating section N shown in FIG. 1.
Figure 7:
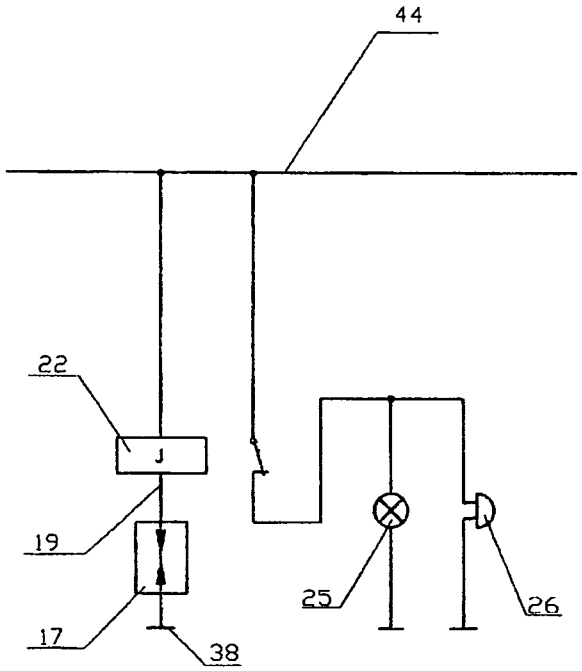
FIG. 7 is schematic diagram of the monitoring system of the tunnel boring machine according to the above preferred embodiment of the present invention.
Figure 8:
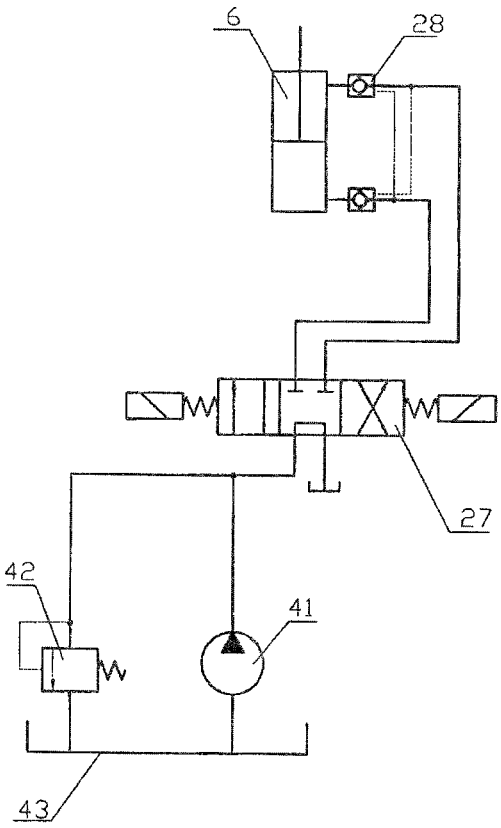
FIG. 8 is another schematic diagram of the cutting device of the tunnel boring machine according to the above preferred embodiment of the present invention.

A tunnel boring machine having a diameter adjustment function comprises a cutting device which comprises a cutting head, a plurality of main cutters mounted on the cutting head, a plurality of peripheral cutters also mounted on the cutting head, and a plurality of peripheral cutter driving mechanisms, a plurality of hydraulic control systems, and a dissipation monitoring system.

The cutting head 40 further has a plurality of grooves 7 spacedly and radially formed thereon, wherein at each outer end portion of each of the grooves 7, two peripheral cutters 1 are symmetrically and spacedly provided on two sides of the outer end portion of the corresponding groove 7 respectively. Moreover, the peripheral cutters 1 provided on a particular groove are connected to a corresponding peripheral cutter driving mechanism which is provided within the corresponding groove 7. Each of the peripheral cutter driving mechanisms comprises a plurality of cutter bases 2 provided on the cutting head 40, a plurality of connecting members 3 connected to the cutter bases 2 respectively, and a supporting member 4 extended between the connecting members 3. In this preferred embodiment of the present invention, each of the peripheral cutters 1 is connected to a sliding base unit 5, wherein each of the sliding base unit 5 is sandwiched between two of the cutter bases 2, wherein each of the cutter bases 2 is connected to one end of the corresponding connecting member 3, while the other end of the connecting member 3 is securely connected to the supporting member 4. The hydraulic control systems are provided on the cutting head 40, wherein each of the hydraulic control systems comprises a hydraulic tank 6 communicated with the corresponding peripheral cutter driving mechanism for driving thereof.

The hydraulic control system further comprises a piston member 13 movably mounted in the hydraulic tank 6 and is communicated with the corresponding supporting member 4, a motion sensor 21 which is provided on the piston member 13, and a connector 10, wherein the motion sensor 21 is electrically connected to the connector 10 through a plurality of electrical wires 29. On the other hand, the connector 10 is communicated with the hydraulic tank 6 through a plurality of transmission tubes 11, whereas the hydraulic tank 6 has a bottom surface 33 connected to a securing base 32, which is connected, preferably through welding, to a corresponding sidewall of the corresponding groove 7. The hydraulic control system further comprises a fluid chamber 43, a relief valve 42, a hydraulic pump 41, a two-way hydraulic lock 28, and an electromagnetic control valve 27. In order to allow users of the present invention to ascertain the position of the peripheral cutters 1, the motion sensor 21 is arranged to send a motion signal to the connector 10 through the electrical wires 29 and the connector 10 is arranged to process the motion signal, and display the corresponding information on a predetermined display unit.

In order to ensure the peripheral cutter driving mechanism to operate stably, securely and accurately, and to minimize a stress transmitted to the piston member 13 when the tunnel boring machine is operating, the hydraulic tank 6 further has a top protection plate 36 provided at a top end thereof, and comprises an inner protective cover 16, and outer protective cover 14, a first guiding member 37, and a second guiding member 15 connected to the outer protective cover 14, wherein the second guiding member 15 also connects to an outer surface of the inner protective cover 16. The hydraulic tank 6 further comprises a bearing base 34 provided between the top protection plate 36 and the inner protective cover 16 in such a manner that a top side of the bearing base 34 is connected to a bottom side of the top protection plate 36, whereas a top side of the inner protective cover 16 is connected to a bottom side of the bearing base 34. The bearing base 34 has a ball bearing 35 fittedly provided therein, wherein an inner diameter of the ball bearing 35 is substantially the same as an outer diameter of the piston member 13. Moreover, the outer protective cover 14 is securely mounted on a bottom side 33 of the hydraulic tank 6.

It is worth mentioning that the monitoring system comprises a detection probe, an alarm device, and a plurality of wires extended between the detection probe and the alarm device. The alarm device comprises an alarm relay 22, a warning light 25 and an alarm speaker 26.

More specifically, the detection probe 17 of the monitoring system is mounted on an extension tube 18 of the cutting head 40, wherein the wires 19 are extended to the detection probe 17 and is connected between an earth terminal 38 and the alarm relay 22 through the connector 10. The detection probe 17 has a tubular structure provided at the extension tube 18, wherein the wires 19 are received and extended in the detection probe 17. The detection probe 17 is filled with epoxy resin 20 for providing sufficient insulation to the wires 19. In order to ensure secure connection between the wires 19 and the detection probe 17, conductive adhesive may be used to adhere the wires 19 on the detection probe 17. The alarm relay 22 is electrically connected to a power source 44, whereas the warning light 25 and the alarm speaker 26 are also connected to the Earth terminal and the power source 44 through a closed terminal of the alarm relay 22.

When the tunnel boring machine is operating, the detection probe 17 and the peripheral cutters 1 are made of the same material so that they have the same material strength and properties, so that dissipation of the peripherals cutter 1 and the detection probe 17 will be substantially identical. When the detection probe 17 has not been dissipated or the dissipation is less than a predetermined threshold, the wires 19 is electrically connected to the Earth and therefore the alarm relay 22 is opened so as to deactivate the warning light 25 and the alarm speaker 26. However, when the dissipation of the detection probe 17 exceeds the predetermined threshold, the alarm relay 22 is closed so as to electrically conduct with the warning light 25 and the alarm speaker 26 for illumination and producing a warning alarm sound respectively. This reminds the technicians and the engineers concerned to replace the corresponding peripheral cutter 1 from the cutting head 40. At the same time, the user of the present invention may control the tunnel boring machine so that the electromagnetic control valve 27 is electrically activated so as to activate the hydraulic pump 41 to drive hydraulic fluid from the hydraulic pump 41 to pass through the two-way hydraulic lock 28 and the transmission tube 11 and a first fluid outlet 8 and fill in the hydraulic tank 6. Thus, the piston member 13 is driven to move the supporting member 4, the connecting members 3 and the cutter bases 2 for driving the corresponding peripheral cutter 1 to move for cutting of rocks. It is worth mentioning that the peripheral cutter 1 is moved along a radial direction of the cutting head 40. In order to drive the peripheral cutter 1 to move to its original position, the hydraulic fluid is arranged to pass through the electromagnetic control valve 27, a second fluid outlet 10 provided on the connector 10, a fluid transmission tube 12, and the two-way hydraulic lock 28 and fill in an upper portion of the hydraulic tank 6 so as to drive the piston member 13, the supporting member 4, the connecting member 3, and the cutter bases 2 to move for driving the peripheral cutter 1 to move back to its original position. Thus, it can be appreciated that by moving the position of the peripheral cutter 1, the radius of the tunnel boring procedure may also be correspondingly varied so as to bore tunnel of differing diameters.

It is important to mention that the cutting head 40 has at least one peripheral cutter 1 and at least one peripheral cutter driving mechanism formed on at least one of the groove 7. Alternatively, the cutting head 40 may have a plurality of peripheral cutters and a plurality of peripheral cutter driving mechanisms formed on a plurality of grooves 7 respectively.

In this preferred embodiment of the present invention, the peripheral cutter driving mechanism may be embodied such that each of the peripheral cutters 1 is connected to a cutter base 2, which is then connected to the supporting member 4.

On the other hand, the detector probe 17 may also employ a tubular structure having a single closed end.

Moreover, a cross sectional shape of the inner protective cover 16 and the outer protective cover 14 can be embodied as square, or circular.

The sliding base unit 5 and the second guiding member 15 are preferably made of plastic material or brass so as to minimize dissipation.

Moreover, an adjustable range of the boring radius formed by the peripheral cutter 1 is between 0 mm and 150 mm.

The motion sensor 21 may be embodied as a magnetostrictive displacement sensor, or eddy current displacement sensor, or a Hall sensor.

What is claimed is:

1. A cutting device for a tunnel boring machine, comprising:

a cutting head having a plurality of grooves radially formed thereon;

a plurality of peripheral cutters mounted on said cutting head at outer end portions of said grooves, wherein every two of said peripheral cutters are symmetrically mounted on said cutting head at two sides of one of said grooves correspondingly, such that said outer end portion of each of said grooves is located between two of said peripheral cutters;

at least one peripheral cutter driving mechanism provided on said groove, wherein said peripheral cutters are connected with said peripheral cutter driving mechanism;

a hydraulic control system driving said peripheral cutter driving mechanism to move, so as to drive said peripheral cutters to move correspondingly; and a monitoring system which comprises a detection probe provided on said cutting head and an alarm device linked to said detection probe, wherein said detection probe and said peripheral cutters are made of the same material and have the same material strength and properties, wherein during cutting operation of said peripheral cutters, said detection probe has the same wear ability of said peripheral cutters, such that when said detection probe is worn over a predetermined threshold, said alarm device is arranged for generating an alarm signal to protect said peripheral cutters being totally worn off.

2. The cutting device, as recited in claim 1, wherein said cutting head has an extension tube provided thereat, wherein said detection probe has a tubular structure provided at said extension tube and is connected to said alarm device by a wire, wherein said detection probe is filled with epoxy resin for insulating said wire therein.

3. The cutting device, as recited in claim 2, wherein said alarm device comprises an alarm relay, wherein said wire is connected between an earth terminal and said alarm relay, and is received in said detection probe such that when said detection probe is worn over said predetermined threshold, said wire transmits an alarm signal to said alarm relay.

4. The cutting device, as recited in claim 3, wherein said alarm device further comprises an alarm speaker, wherein when a wear condition of said detection probe exceeds said predetermined threshold, said alarm relay is activated to electrically activate with said alarm speaker for producing a warning alarm sound.

5. The cutting device, as recited in claim 4, wherein said peripheral cutter driving mechanism comprises a plurality of cutter bases provided on said cutting head and coupled with said peripheral cutters respectively, a plurality of sliding base units each being sandwiched between two of said cutter bases, a plurality of connecting members connected to said cutter bases respectively, and a supporting member extended between said connecting members.

6. The cutting device, as recited in claim 5, wherein said hydraulic control system further comprises a hydraulic cylinder and a piston member movably mounted in said hydraulic cylinder, wherein said piston member is connected with said supporting member to drive said peripheral cutters to move in a radial direction.

7. The cutting device, as recited in claim 6, wherein said hydraulic control system further comprises a connector communicated with said hydraulic cylinder through a transmission tube, a fluid chamber, a relief valve linked to said fluid chamber, a hydraulic pump, a two-way hydraulic lock linked between said hydraulic cylinder and said hydraulic pump, and an electromagnetic control valve linked between said hydraulic cylinder and said hydraulic pump.

8. The cutting device, as recited in claim 7, wherein said hydraulic cylinder comprises an inner protective cover, and outer protective cover, a first guiding member, and a second guiding member connected to said outer protective cover, wherein said second guiding member also connects to an outer surface of said inner protective cover, wherein said hydraulic cylinder further comprises a bearing base provided between said top protection plate and said inner protective cover in such a manner that a top side of said bearing base is connected to a bottom side of said top protection plate, whereas a top side of said inner protective cover is connected to a bottom side of said bearing base, wherein said bearing base has a ball bearing fittedly provided therein, wherein an inner diameter of said ball bearing is the same as an outer diameter of said piston member.

9. The cutting device, as recited in claim 1, wherein said peripheral cutter driving mechanism comprises a plurality of cutter bases provided on said cutting head and coupled with said peripheral cutters respectively, a plurality of sliding base units each being sandwiched between two of said cutter bases, a plurality of connecting members connected to said cutter bases respectively, and a supporting member extended between said connecting members.

10. The cutting device, as recited in claim 9, wherein said hydraulic control system further comprises a hydraulic cylinder and a piston member movably mounted in said hydraulic cylinder, wherein said piston member is connected with said supporting member to drive said peripheral cutters to move in a radial direction.

11. The cutting device, as recited in claim 10, wherein said hydraulic control system further comprises a connector communicated with said hydraulic cylinder through a transmission tube, a fluid chamber, a relief valve linked to said fluid chamber, a hydraulic pump, a two-way hydraulic lock linked between said hydraulic cylinder and said hydraulic pump, and an electromagnetic control valve linked between said hydraulic cylinder and said hydraulic pump.

12. The cutting device, as recited in claim 11, wherein said hydraulic cylinder comprises an inner protective cover, and outer protective cover, a first guiding member, and a second guiding member connected to said outer protective cover, wherein said second guiding member also connects to an outer surface of said inner protective cover, wherein said hydraulic cylinder further comprises a bearing base provided between said top protection plate and said inner protective cover in such a manner that a top side of said bearing base is connected to a bottom side of said top protection plate, whereas a top side of said inner protective cover is connected to a bottom side of said bearing base, wherein said bearing base has a ball bearing fittedly provided therein, wherein an inner diameter of said ball bearing is the same as an outer diameter of said piston member.

* * * * *